US006343652B1

(12) United States Patent
Corre et al.

(10) Patent No.: US 6,343,652 B1
(45) Date of Patent: Feb. 5, 2002

(54) METHOD AND DEVICE FOR CLEANING OUT A WELL OR PIPING BLOCKED WITH GAS HYDRATES

(75) Inventors: Pierre-Yves Corre, Montfort-sur-Meu; James Leighton, L'Hermitage; Jean-Louis Saltel, Le Rheu, all of (FR)

(73) Assignee: Drillflex, Noyal-Chatillon (FR)

( * ) Notice: Subject to any disclaimer, the term of this patent is extended or adjusted under 35 U.S.C. 154(b) by 0 days.

(21) Appl. No.: 09/424,682

(22) PCT Filed: May 20, 1998

(86) PCT No.: PCT/FR98/01017

§ 371 Date: Mar. 6, 2000

§ 102(e) Date: Mar. 6, 2000

(87) PCT Pub. No.: WO98/54440

PCT Pub. Date: Dec. 3, 1998

(30) Foreign Application Priority Data

May 30, 1997 (FR) ..... 97 06925

(51) Int. Cl.[7] ..... F21B 43/24

(52) U.S. Cl. ..... 166/302; 166/60; 166/62; 392/305; 175/18

(58) Field of Search ..... 166/302, 60, 62; 392/305; 175/18

(56) References Cited

U.S. PATENT DOCUMENTS

| | | | | |
|---|---|---|---|---|
| 3,101,116 A | | 8/1963 | Spitz | |
| 4,923,019 A | * | 5/1990 | Gammon | 175/14 |
| 5,168,929 A | | 12/1992 | Galloway | |
| 5,400,430 A | | 3/1995 | Nenniger | |
| 5,484,027 A | * | 1/1996 | Greenlaw et al. | 175/18 |
| 5,619,611 A | | 4/1997 | Loschen et al. | |

* cited by examiner

*Primary Examiner*—William Neuder
(74) *Attorney, Agent, or Firm*—John J. Ryberg; Brigitte L. Jeffery

(57) ABSTRACT

A method and apparatus for unplugging a well or pipe obstructed by a gas hydrates. According to the invention, a moving heating element is applied against one end of the hydrate plug, and is displaced axially in the tube or the pipe towards the other end, so as to cause the plug to melt progressively from one end to the other. Application to the oil industry, in particular in off-shore wells.

10 Claims, 3 Drawing Sheets

METHOD AND DEVICE FOR CLEANING OUT A WELL OR PIPING BLOCKED WITH GAS HYDRATES

The present invention relates to a method and to apparatus for unplugging a well or a pipe which is obstructed by a solid plug of gas hydrates.

BACKGROUND OF THE INVENTION

In the oil trade or industry, a problem sometimes arises associated with the appearance of solid plugs inside a borehole or a pipe for transporting oil products, in particular pipeline or a feed pipe.

In the present description, the terms "upstream" and "downstream" when relating to a well or pipe correspond to the direction in which the oil product flows in the well or in the pipe.

Thus, when referring to an oil well, for example, its upstream end is level with the hydrocarbon reservoir, while its downstream end is at the surface.

Hydrate plugs are observed to form in wells or pipes in which the internal bore is at a pressure which is very high and at a temperature which is low.

This occurs in particular in off-shore wells.

Hydrates are substances made up essentially of water, together with various chemical substances, and having a melting temperature of about 0° C. at atmospheric pressure.

This melting temperature increases relatively fast with pressure. Thus, by way of indication, this melting temperature is about 10° C. at a pressure of 20 bars, 15° C. at a pressure of 50 bars, 20° C. at a pressure of 100 bars, and 22° C. at a pressure of 200 bars.

Still by way of indication, in the North Sea, where there are to be found numerous oil-bearing deposits in production, the temperature is substantially constant and about 8° C. to 9° C.

The pressure that exists in the wells or pipes often lies in the range 50 bars to 300 bars, and consequently corresponds to hydrates existing in the solid state.

To prevent such solidification, it is general practice to insert antifreeze liquids, in particular methanol, into wells or pipes for the purpose of lowering the melting point of the mixture very significantly.

Although that method generally gives satisfaction, it can nevertheless happen accidentally that solid hydrate plugs appear, thereby obstructing the well or pipe and preventing it from being used.

So far as the Applicant is aware, there does not exist at present any method or apparatus that is really adapted to eliminating such plugs.

Two methods are used.

The first consists in expelling hydrate plugs by inserting a fluid under very high pressure into the well or the pipe.

That solution is effective in certain cases only.

Another method consists in drilling through the plug(s), thereby making it necessary to use equipment that is extremely sophisticated and expensive, while nevertheless compromising the integrity of the well or the pipe; there is a risk of the drilling tool damaging the walls of the well or the pipe during the operation.

SUMMARY OF THE INVENTION

That is why the present invention proposes filling this void, by proposing a method and apparatus that enable the well or the pipe to be unplugged in a manner that is simple and of low cost, completely safe, and without running the risk of damaging the walls.

The method of the invention for unplugging a well or a pipe obstructed by a solid hydrate plug and which enables this object to be achieved is remarkable in that a moving heating element is pressed against one end of said plug, and is displaced axially in the tube or pipe towards the other end so as to cause the plug to melt progressively from one end to the other.

In one possible implementation of this method, during the operation, an "antifreeze" liquid is supplied for lowering the melting temperature of the hydrate plug inside the well or the pipe in the vicinity of the end of the plug against which the heating element is applied.

Advantageously, the heating element is electrically heated.

According to another characteristic of the method, the heater element is displaced under the effect of gravity.

Naturally, this assumes that the well or the pipe extends in a vertical direction or at least slopes with a significant vertical component.

In a variant, the element is displaced by thrust, with the thrust action being assisted or otherwise by the effect of gravity.

In a preferred implementation of the invention, a moving heating element is applied against one end of said plug while an antifreeze liquid is caused to circulate inside the well or pipe in a closed circuit in the vicinity of said end while simultaneously displacing the heating element axially towards the other end of the plug in such a manner that the heat delivered by the heating element and the presence of the antifreeze liquid together ensure that the plug melts progressively and irreversibly.

In which case, said heating element advantageously includes electrical resistances for providing heating by the Joule effect, while the antifreeze liquid is circulated by means of an electric pump, and the electrical power for said electrical resistances and the pump is delivered from surface equipment by means of conductors located in a suspension cable or rod.

The apparatus which also forms part of the present invention and which serves to unplug a well or a pipe obstructed by a solid hydrate plug is remarkable in that it comprises a moving heating element adapted to be inserted in and displaced axially along the well or the pipe in such a manner as to be applied against one end of said plug and to cause it to melt progressively from one end to the other while being displaced towards the other end.

Furthermore, according to various additional but non-limiting characteristics of the invention:

- said heating element is a metal body that conducts heat and that houses electrical resistances that are electrically powered from surface equipment;
- the apparatus includes means for injecting an antifreeze liquid into the well or the pipe in the vicinity of the hydrate plug;
- the apparatus includes means for continuously recycling the antifreeze liquid;
- said heating element is an elongate body whose free end for being applied against the hydrate plug is of generally tapering shape; and
- the apparatus is suspended from a cable connected to the surface equipment, and it is lowered by gravity inside the tube or the pipe, said cable containing various electrical conductors enabling the apparatus to operate, in particular to power the heating resistances and, where appropriate, the pump which circulates the antifreeze.

In a preferred embodiment, the apparatus comprises:

a) a moving heating element constituted by an elongate metal body that conducts heat, the free end of the body for application against the hydrate plug being of a generally tapering shape;

b) electrical resistances housed in the body and suitable for heating it by the Joule effect;

c) an electric pump secured to the heating element and adapted to cause an antifreeze liquid to circulate in a closed circuit around the tapering end; and d) a cable or rod to which the heating element and the pump are fixed and via which they are connected to surface equipment, said cable or rod containing electrical conductors for electrically powering the resistances and the pump.

BRIEF DESCRIPTION OF THE DRAWINGS

Other characteristics and advantages of the invention appear from the description and the accompanying drawings which show one possible embodiment by way of non-limiting example.

In the drawings.

DETAILED DESCRIPTION OF THE PREFERRED EMBODIMENT

Figure 1:
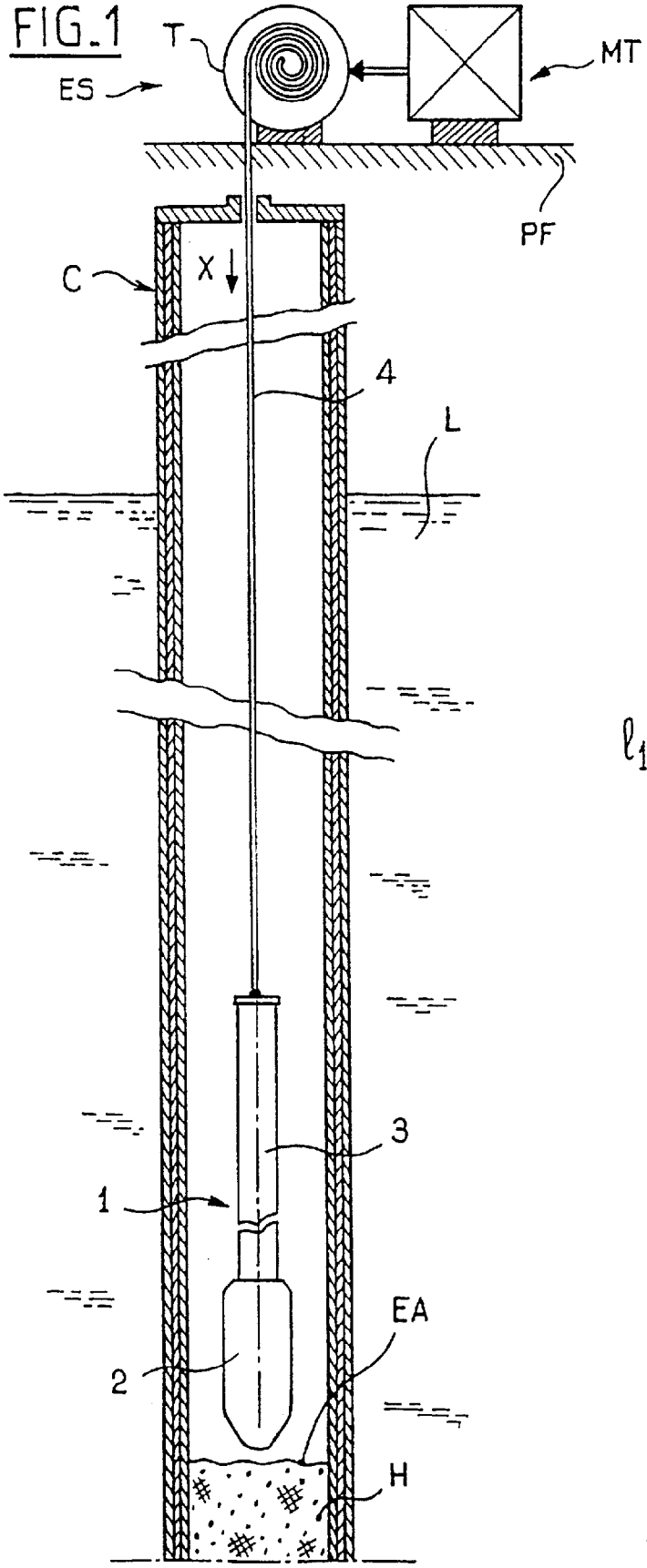
FIG. 1 is a diagrammatic overall view of the apparatus installed on site (in a well).

In FIG. 1, there can be seen a diagram of an off-shore oil well whose drilling platform PF supports surface equipment ES of conventional type and including, amongst other things, a winch T and a telemetry module MT.

The well has a casing assembly designated by the reference C.

In general, such an assembly is made up of three concentric tubes known in the art (from the outside towards the inside) by the terms "riser", "casing", and "tubing".

Only the downstream end portion of this casing is shown, which portion in the example shown is partially immersed in a liquid L, specifically in sea water.

By way of indication, the immersed length of the pipe C is of the order of several tens to several hundreds of meters, while the portion in the ground and giving access to the hydrocarbon reservoir is much longer.

Except in the relatively shallow surface layer where temperature fluctuates, the temperature of the mass of water is substantially constant. As mentioned above, in the North Sea, this temperature is about 8° C. to 9° C.

It is in this zone that the problem of hydrate plug formation arises.

Hydrates are generally in the form of isolated plugs of unit length lying in the range 1 meter to 10 meters, with plugs being separated by liquid zones. In all, the entire plug can reach a length of several hundreds of meters.

The apparatus 1 of the invention essentially comprises a head 2, a tool 3, and a suspension cable or rod 4.

The cable or rod 4 whose free end is attached and connected to the tool 3 can be of the type that is generally used for logging, and comprises a bundle of electrically conductive cables suitable for delivering the electricity required for powering and controlling the equipment lowered down the well from the surface equipment, and also suitable for transferring to the surface, i.e. in the opposite direction, the various electrical signals that emanate from the various sensors with which the equipment is fitted.

The cable or rod 4 is wound on the drum of the winch T.

The module MT controls the winding-out or -in of the cable or the rod by means of said drum, in such a manner as to drive the apparatus 1 down or up before, during, and after the operation.

The module MT is also electrically connected to the cable or rod 4 in order to perform the operation, as explained below.

Figure 5:
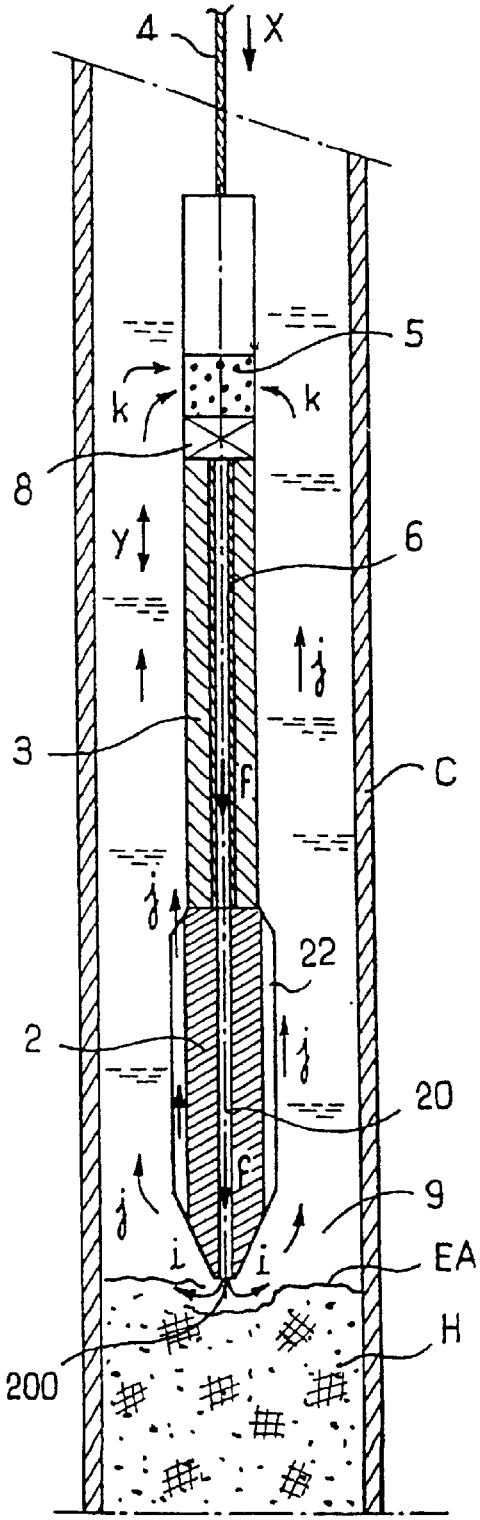
FIG. 5 is a view similar to FIG. 2 on a smaller scale and showing the unplugging operation.

In FIGS. 1 and 5, there is shown the top portion of a solid hydrate plug that has formed accidentally in the casing C.

This constitutes a cylindrical plug of ice given reference H in the figures.

The head 2 is substantially bullet-shaped having a cylindrical body whose downwardly-directed free end or nose is of tapering shape, e.g. being frustoconical.

By way of indication, if the inside diameter of the casing C is 150 mm, the diameter of the head 2 is about 90 mm.

Figure 2:
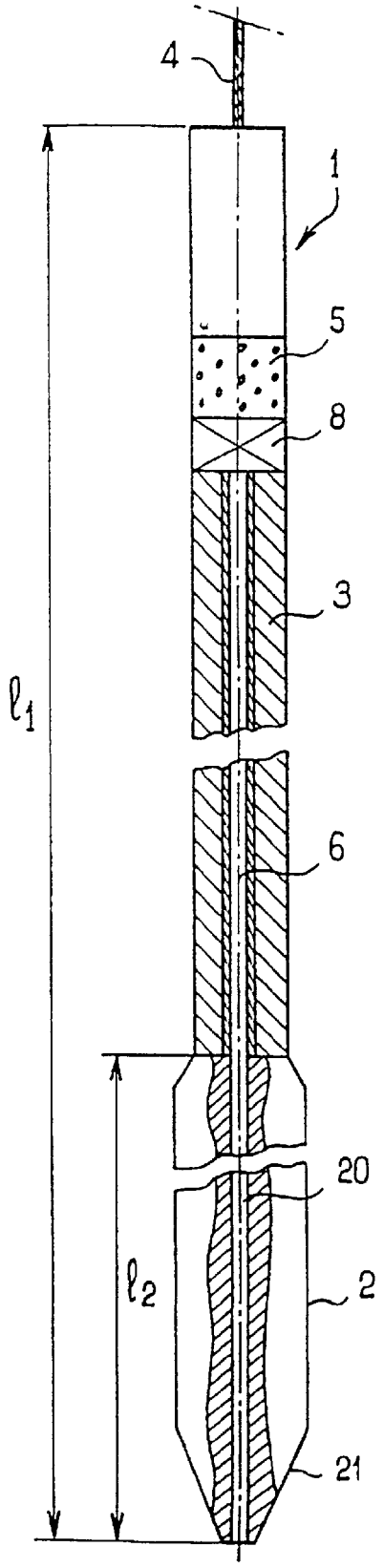
FIG. 2 is a diagrammatic view of apparatus of the invention shown partially in section on a vertical axial plane.

Its height, referenced $l_2$ in FIG. 2, is about 1 meter, for example.

The tool 3 in the form of a cylindrical rod is fixed to the head 2 by appropriate means. Its diameter is significantly smaller than that of the head 2.

By way of indication, the total length $l_1$ of the apparatus is about 5 meters.

As explained below with reference to FIGS. 3 and 4, the portion 2 is a heater element of a material that is a good conductor of heat. The material constituting it also has good mechanical strength properties.

Various metals possess the required characteristics; as examples, mention can be made of steel and bronze.

In its "downstream" end portion (remote from the head 2), the rod 3 is fitted with an electric pump 8 associated with a strainer 5.

The pump is adapted to suck in the surrounding liquid that is to be found around the strainer and to deliver it into a central tube 6 on the axis of the rod 3.

The tube 6 opens out into a central channel 20 passing through the heater element 2 from one end to the other.

Figure 3:
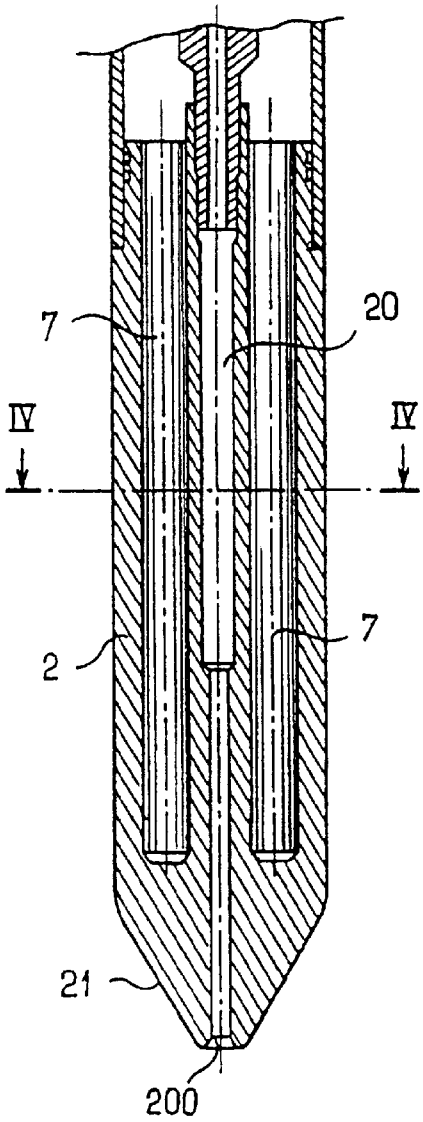
FIG. 3 is an axial section view of the heater element constituting part of the apparatus.
Figure 4:
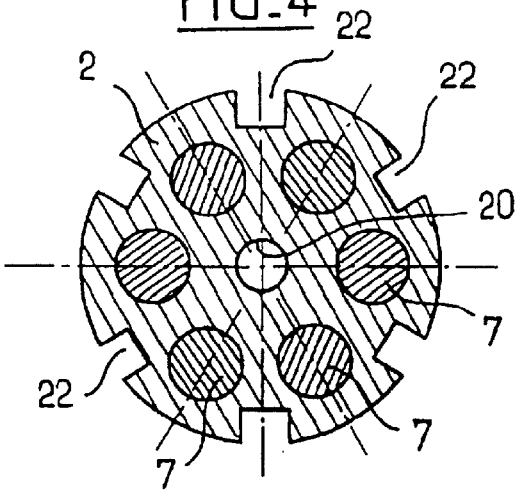
FIG. 4 is a cross-section view on a larger scale through the element of FIG. 3, the section plane being referenced IV—IV in FIG. 3.

As can be seen in FIGS. 3 and 4, the heater element 2 is provided with electrical heating resistances 7. In the example shown, there are six such resistances regularly distributed at 60° intervals around the central channel 20.

These resistances are of conventional type, e.g. of the type referred to as "heating pencils" of composite steel/ceramic structure having Joule effect heating wires integrated therein.

Advantageously, the periphery of the element 2 is fluted by a set of longitudinal grooves 22, of which there are likewise six, extending in register with the gaps between pairs of adjacent heating resistances (see FIG. 4).

Reference 200 designates the outlet from the channel 20 which opens out axially into the central portion of the nose 21.

The heating elements 7 and the electric pump 8 are electrically powered by appropriate conductors (not shown) which are grouped together in the cable or the rod 4 and which communicate with the surface equipment ES.

The apparatus 1 also has a set of electronic sensors (not shown) of conventional type that are likewise connected to the surface equipment and that serve to measure and monitor various parameters during the operation, in particular temperature, antifreeze flow rate, and the pressure with which the head 2 is applied against the hydrate plug H.

That constitutes instrumentation that is usual in the field of drilling and managing an oil well, which is why it is not described in greater detail herein so as to avoid pointlessly burdening the description.

There follows a description of how a solid hydrate plug H is eliminated using the apparatus as described above.

A casing C is generally filled with a liquid mixture of water and antifreeze. As an appropriate antifreeze, mention can be made of methanol.

Preferably, prior to the operation, a certain volume of relatively undiluted antifreeze is injected using appropriate and conventional means into the inside of the casing C into the zone situated immediately above the solid plug H.

The apparatus is lowered inside the casing C by actuating the winch T in the winding-out direction, as represented by arrow X.

This displacement is stopped when the head 2 comes to bear against the top (or downstream) end EA of the plug H.

Pressure sensors (not shown) mounted on the apparatus 1 serve to identify this situation, and consequently to cause movement to be stopped and restarted via the module MT.

Electrical power is fed to the heating resistances 7 and to the pump 8.

By way of indication, the heating elements 7 are powered from the surface using DC, at a voltage lying in the range 300 V to 1000 V, and at power lying in the range 5 kW to 15 kW, e.g. about 7 kW to 8 kW.

The temperature of the element 2 is advantageously raised to a value lying in the range 50° C. to 100° C.

The delivery rate of the pump 8 can be a few liters per minute.

Because of its contact with the portion 21 of the heated head 2, and also because the ambient liquids are heated at this level, the end EA of the hydrate plug begins to melt.

The tapering shape of the heating head facilitates penetration thereof into the plug, causing the plug to melt progressively.

As melting takes place, the apparatus 1 moves down inside the tube under the effect of gravity, with the winch T being controlled appropriately to allow the cable 4 to "run out" and/or by applying axial thrust when a rod is used (i.e. a rod that is axially rigid).

In addition, with the pump 8 in operation, the mass of liquid 9 situated above the plug H and containing antifreeze is put into circulation.

The circulatory path followed by the liquid is represented by arrows in FIG. 5.

The pump 8 delivers the antifreeze mixture downwards into the pipe 6 and then into the channel 20 (arrows f).

At the outlet 200 from the element 2, the mixture comes into contact with the surface EA of the plug (arrows i).

This has the effect of opposing re-solidification of the plug and of making the melting thereof irreversible.

The mixture then rises all around the element 2, including within its peripheral grooves 22 and then along the tool 3 (arrows j).

Thereafter some of the liquid is sucked in through the strainer 5 (arrows k).

In order to homogenize the liquid mass situated above the plug H, which mass also includes the hydrates that have just been melted, it is preferable to displace the apparatus 1 periodically with reciprocating vertical back and forth motion, as symbolized by double-headed arrow Y. This motion is controlled by the module MT.

It is commonplace for a single casing to be obstructed by a plurality of hydrate plugs separated by liquid zones.

In accordance with the invention, it is naturally the first plug which is eliminated first by melting, after which the apparatus is displaced until it comes to bear against the following plug, and the operation is repeated successively for each of the plugs.

By way of indication, the rate of progress of the heating head inside a hydrate plug while it is being melted is about 1 meter per hour.

The combination of melting and circulating an antifreeze mixture makes it possible to work in optimum manner.

Providing the element 2 possesses a large amount of thermal inertia, it can be heated intermittently (discontinuous electrical power) instead of being powered permanently throughout the operation. In which case, antifreeze pumping can also be discontinuous, e.g. having periods of heating alternating with periods of pumping.

Figure 6:
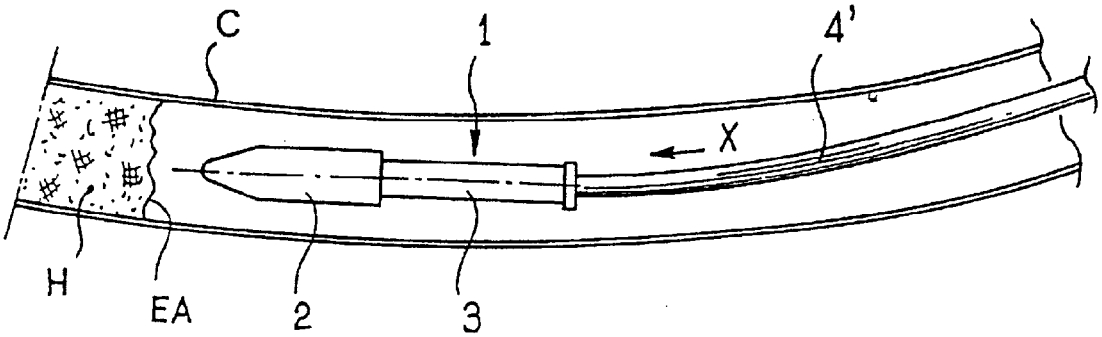
FIGS. 6 and 7 are diagrammatic views of two variants of the apparatus inside a pipe.

In FIG. 6, the method is implemented in a pipe C, e.g. a horizontal pipe. The device 1 is fixed to a flexible rod 4' which is axially rigid, but which possesses a certain amount of flexibility enabling it to follow any curves that might exist in the pipe.

The rod 4' is engaged in the tube, and it is pressed against the hydrate plug H by applying thrust X to the rod by appropriate means (not shown) situated at its other end, outside the pipe.

Figure 7:
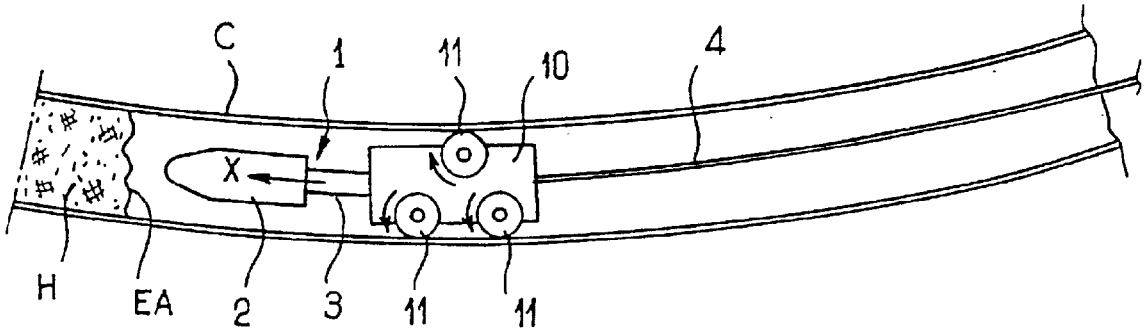

In the variant of FIG. 7, the device 1 is carried by a small carriage 10 connected to the cable 4. The carriage is provided with guide wheels 11 bearing against the inside wall of the pipe C. At least some of the wheels are drive wheels, with the directions of rotation thereof being represented by arrows in the figure. They are driven by an electric motor which is likewise powered via the cable 4. When the carriage is in operation, it displaces the heating head 2 inside the pipe C so as to press it against the hydrate plug H, and push it against the plug so as to enable the operation to be performed.

What is claimed is:

1. A method of unplugging a well obstructed by a solid hydrate plug, wherein a moving heating element is pressed against one end of the plug, and is displaced axially in the tube or pipe towards the other end of the plug so as to cause the plug to melt progressively from the one end to the other end of the plug; and during this operation, an antifreeze liquid is supplied for lowering the melting temperature of the hydrate plug inside the well in the vicinity of the end of the plug against which the heating element is applied.

2. A method as claimed in claim 1, wherein the heating element is electrically heated.

3. A method as claimed in claim 1, wherein the heating element is displaced under the effect of gravity.

4. A method as claimed in claim 1, wherein the heating element is displaced under the effect of thrust.

5. A method of unplugging a well obstructed by solid hydrate plug, wherein a moving heating element is applied against one end of the plug while an antifreeze liquid is caused to circulate inside the well in a closed circuit in the vicinity of the one end of the plug while simultaneously displacing the heating element axially towards the other end of the plug in such a manner that the heat delivered by the heating element and the presence of the antifreeze liquid together ensure that the plug melts progressively and irreversibly.

6. A method as claimed in claim 5, in which the heating element includes electrical resistances for providing heating by the Joule effect while the antifreeze liquid is circulated by means of an electric pump, wherein electrical power for the electrical resistances and the pump is delivered from surface equipment by means of conductors located in a suspension cable or rod.

7. Apparatus for unplugging a well obstructed by a solid hydrate plug, the apparatus comprising:

(i) a moving heating element adapted to be inserted in and displaced axially along the well in such a manner as to be applied against one end of the plug and to cause it to melt progressively from the one end to the other while being displaced towards the other end of the plug;

(ii) means for injecting an antifreeze liquid into the well or the pipe in the vicinity of the hydrate plug; and (iii) means for continuously recycling the antifreeze liquid.

8. Apparatus for unplugging a well obstructed by a solid hydrate plug, the apparatus comprising a moving heating element adapted to be inserted in and displaced axially along the well in such a manner as to be applied against one end of the plug and to cause it to melt progressively from the one end to the other while being displaced towards the other end of the plug; the apparatus being fixed to a cable or rod connected to the surface equipment and displaced by gravity inside the well, the cable or rod containing electrical conductors enabling the apparatus to operate to power heating resistances in the heating element.

9. Apparatus for unplugging a well obstructed by a solid hydrate plug, the apparatus comprising a moving heating element adapted to be inserted in and displaced axially along the well in such a manner as to be applied against one end of the plug and to cause it to melt progressively from the one end to the other while being displaced towards the other end of the plug; the apparatus being fixed to a cable or rod connected to the surface equipment and displaced by gravity inside the well, the cable or rod containing electrical conductors enabling the apparatus to operate to power a pump which circulates antifreeze in the well.

10. Apparatus for unplugging a well obstructed by a solid hydrate plug, the apparatus comprising:

a) a moving heating element constituted by an elongate metal body that conducts heat, the body having a free end for application against the hydrate plug of a generally tapering shape;

b) electrical resistances housed in the body and suitable for heating it by the Joule effect;

c) an electric pump secured to the heating element and adapted to cause an antifreeze liquid to circulate in a closed circuit around the tapering end; and d) a cable or rod to which the heating element and the pump are fixed and via which they are connected to surface equipment, said cable or rod containing electrical conductors for electrically powering the resistances and the pump.

* * * * *